US005915928A

United States Patent [19]

Murase et al.

[11] Patent Number: 5,915,928

[45] Date of Patent: Jun. 29, 1999

[54] COMPRESSOR HAVING A SWASH PLATE WITH A LUBRICATION HOLE

[75] Inventors: Masakazu Murase; Tetsuhiko Fukanuma; Masahiko Okada; Hiroshi Kubo, all of Kariya, Japan

[73] Assignee: Kabushiki Kaisha Toyoda Jidoshokki Seisakusho, Kariya, Japan

[21] Appl. No.: 08/812,760

[22] Filed: Mar. 6, 1997

[30] Foreign Application Priority Data

Mar. 19, 1996 [JP] Japan ..... 8-063094

[51] Int. Cl.[6] ..... F04B 1/12

[52] U.S. Cl. ..... 417/269; 184/16.17; 92/71

[58] Field of Search ..... 417/269; 184/6.17, 184/6.19; 92/71

[56] References Cited

U.S. PATENT DOCUMENTS

| | | | |
|---|---|---|---|
| 5,173,032 | 12/1992 | Taguchi et al. . | |
| 5,779,004 | 7/1998 | Hoshino et al. | 184/6.17 |
| 5,782,316 | 7/1998 | Kobayashi et al. | 184/6.17 |
| 5,784,950 | 7/1998 | Kayukawa et al. | 92/71 |

FOREIGN PATENT DOCUMENTS

| | | |
|---|---|---|
| 0628722 | 12/1994 | European Pat. Off. . |
| 2422346 | 11/1974 | Germany . |
| 3638000 | 5/1987 | Germany . |
| 4327948 | 3/1994 | Germany . |
| 4331910 | 3/1995 | Germany . |
| 07286581 | 10/1995 | Japan . |

*Primary Examiner*—Timothy S. Thorpe
*Assistant Examiner*—Ehud Gartenberg
*Attorney, Agent, or Firm*—Morgan & Finnegan, LLP

[57] ABSTRACT

An improved lubricating structure of a compressor is disclosed. A swash plate is tiltably supported on the drive shaft for an integral rotation therewith. A plurality of pistons are operably coupled to the swash plate. The rotation of the swash plate is converted to a reciprocal movement of each piston in an associated cylinder bore to compress and discharge gas that contains oil. A clearance is defined by the cylinder bore and the piston enabling the compressed gas to flow out from the cylinder bore to the swash plate. The swash plate has an operation area that receives greatest compression load based on reaction force of the compressed gas acting on the piston when the swash plate rotates. The swash plate has at least one bore for attaching the swash plate to a jig when the swash plate is ground during its manufacturing process. The bore is arranged to allow the gas flow out to the swash plate from the cylinder bore through the clearance to flow to the operation area.

22 Claims, 8 Drawing Sheets

COMPRESSOR HAVING A SWASH PLATE WITH A LUBRICATION HOLE

BACKGROUND OF THE INVENTION

1. Field of the Invention

The present invention relates to lubricating structures for compressors, and more particularly, to improvements in circulation passages for lubricating oil in compressors that employ swash plates.

2. Description of the Related Art

A typical variable displacement compressor that employs a swash plate has a cylinder bore and a piston accommodated therein. A compression chamber is defined in the cylinder bore by the piston. The piston is coupled to the swash plate by means of shoes. The swash plate is arranged in the crank chamber about a drive shaft. A hinge mechanism supports the swash plate in a manner such that it is inclined in accordance with the difference between the pressure in the crank chamber and the pressure acting on the face of the piston. In this type of compressor, the swash plate is moved to a minimum inclination position at which its inclination becomes minimal with respect to a plane perpendicular to the drive shaft (the state in which the compressor displacement is minimal). When the swash plate is located at the minimum inclination position, lubricating oil, which is contained in a refrigerant, is conveyed from the compression chamber to the crank chamber through a clearance defined between the piston and the wall of the cylinder bore to lubricate the swash plate and the shoes. With regard to the swash plate, a considerable amount of load is applied to a portion corresponding with the hinge mechanism in the axial direction of the drive shaft. The load applied to this portion is greater than the load applied to other portions of the swash plate. Accordingly, it is particularly important that the portion receiving the heavy load be sufficiently lubricated to improve the durability of the swash plate.

The swash plate is provided with a shaft hole to insert the drive shaft therethrough. When machining a workpiece to form the swash plate, a reference hole extending parallel to the shaft hole is provided in addition to the shaft hole. The workpiece, which is cast and disk-like, is secured to a jig. The jig is fixed on a table of a numerically controlled (NC) milling machine. The workpiece is machined by a grinding stone that is attached to a spindle of the milling machine. The workpiece must be fixed to the jig so as to prevent it from rotating when undergoing machining. Thus, a center shaft projecting from the jig is inserted through the shaft hole of the workpiece while a positioning pin projecting from the jig is inserted through the reference hole. In this manner, the workpiece is supported at two locations by the jig to prevent rotation of the workpiece. This enables stable machining of the workpiece when forming the swash plate.

As described above, the lubricating oil contained in the refrigerant is conveyed from the compression chamber toward the crank chamber via the clearance defined between the piston and the wall of the cylinder bore. When the lubricating oil leaks into the crank chamber, the oil advances along the surface of the swash plate toward the shoes and then lubricates between the swash plate and the shoes. However, the refrigerant containing the lubricating oil flows into the reference hole. This affects the flow of the lubricating oil in an undesirable manner. Insufficient lubrication of the region receiving the heaviest load results in early wear of the plate. Such insufficient lubrication is especially troublesome in compressors that do not use clutches (clutchless compressors) such as those described in Japanese Unexamined Patent Publication Nos. 3-37378 and 7-286581.

In a typical clutchless compressor, it is important to prevent excessive compressor displacement when cooling is not required and to prevent frost from forming in the associated evaporator. The circulation of refrigerant through the external refrigerant circuit is stopped when cooling is not required or when there is a possibility of the formation of frost. In the compressors of Japanese Unexamined Patent Publication Nos. 3-37378 and 7-286581, the circulation of refrigerant in the external refrigerant circuit is stopped by impeding the flow of refrigerant gas entering the suction chamber of the compressor from the external refrigerant circuit. In these compressors, when the flow of refrigerant gas from the external refrigerant circuit to the suction chamber is impeded, the swash plate is moved to the minimum inclination position. If the flow of refrigerant gas from the external refrigerant circuit to the suction chamber is commenced, the inclination of the swash plate is increased from the minimum inclination. When the swash plate is located at the minimum inclination position, the refrigerant in the external refrigerant circuit does not return to the compressor. In this case, lubrication of the interior of the compressor is carried out by the lubricating oil contained in the refrigerant that circulates within the compressor. The refrigerant passing through the clearance is part of the refrigerant circulating within the compressor. Thus, when the lubricating oil that is contained in the circulating refrigerant becomes insufficient, it is difficult to avoid early wear since the swash plate is constantly rotated during operation of the external drive source that drives the compressor.

SUMMARY OF THE INVENTION

Accordingly, it is an objective of the present invention to provide a lubricating structure that ensures long life of a swash plate in a compressor, which inclinably supports the swash plate in a crank chamber and which controls the inclination of the swash plate in accordance with the difference between the pressure in the crank chamber and the pressure acting on the face of a piston.

It is another objective of the present invention to provide a lubricating structure for a compressor that enables efficient lubrication of the swash plate at portions receiving a high degree of load.

It is a further objective of the present invention to provide a lubricating structure for a compressor that employs a swash plate having superior strength.

To achieve the above objectives, an improved lubricating structure of a compressor is disclosed. A swash plate is tiltably supported on the drive shaft for integral rotation therewith. A plurality of pistons are operably coupled to the swash plate. The rotation of the swash plate is converted to reciprocal movement of each piston in an associated cylinder bore to compress and discharge gas that contains oil. A clearance is defined by the cylinder bore and the piston enabling the compressed gas to flow out from the cylinder bore to the swash plate. The swash plate has an operation area that receives greatest compression load based on reaction force of the compressed gas acting on the piston when the swash plate rotates. The swash plate has at least one bore for attaching the swash plate to a jig when the swash plate is ground during its manufacturing process. The bore is arranged to allow the gas flow out to the swash plate from the cylinder bore through the clearance to flow to the operation area.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 7(A) is a cross-sectional view taken along a location corresponding to FIG. 2, and FIG. 7(B) is a perspective view showing the rear side of the swash plate;

FIG. 8(A) is a perspective view showing the front side of the swash plate, and FIG. 8(B) is a perspective view showing the rear side of the swash plate; FIG. 9(A) is a perspective view showing the front side of the swash plate, and FIG. 9(B) is a perspective view showing the rear side of the swash plate.

DETAILED DESCRIPTION OF THE PREFERRED EMBODIMENTS

A clutchless variable displacement compressor according to a first embodiment of the present invention will hereafter be described with reference to FIGS. 1 to 6.

Figure 1:
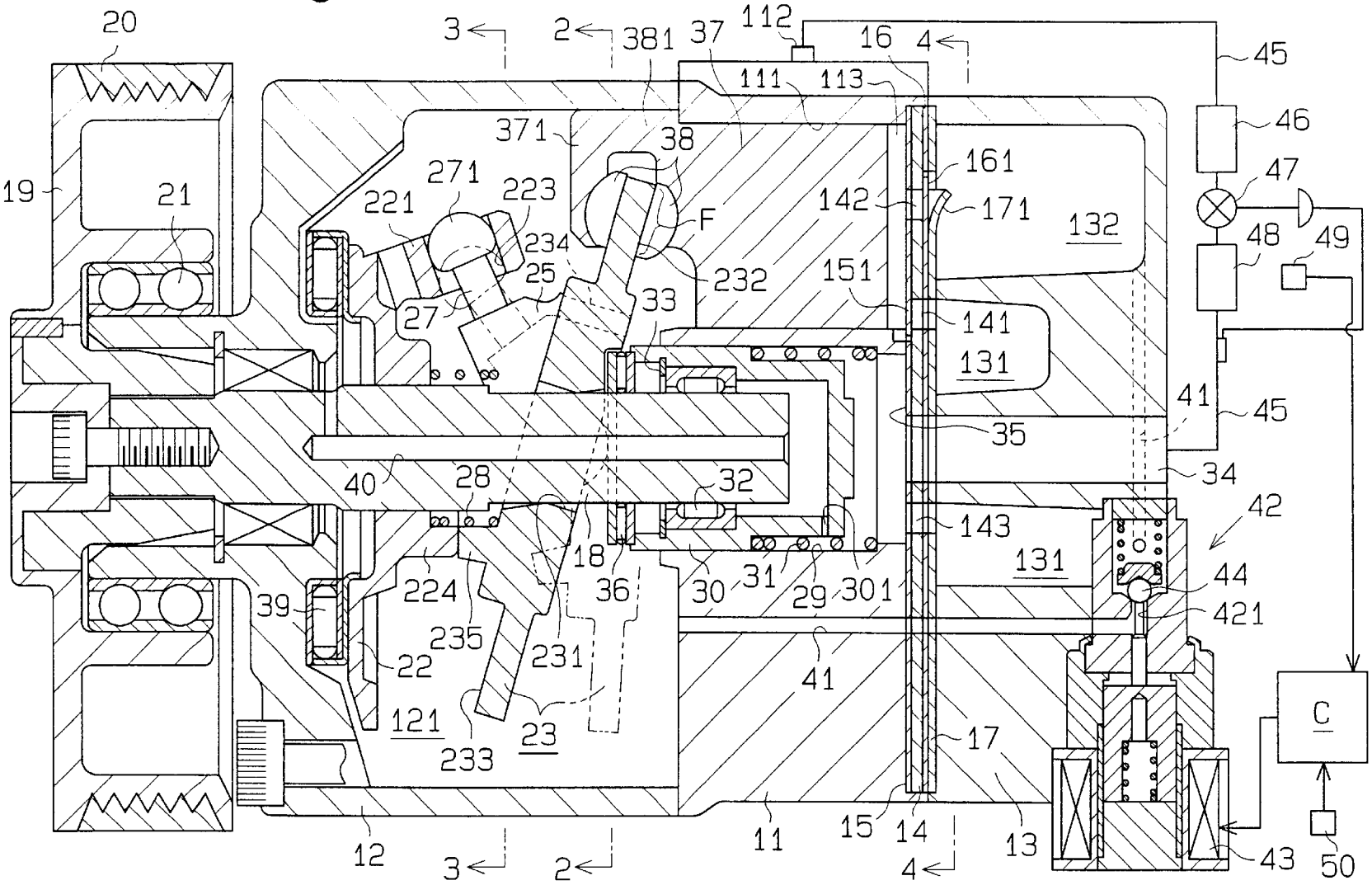
FIG. 1 is a cross-sectional side view showing a compressor according to a first embodiment of the present invention.

As shown in FIG. 1, a front housing 12 is fastened to the front end of a cylinder block 11. A rear housing 13 is fastened to the rear end of the cylinder block 11. First, second, and third valve plates 14, 15, 16 and a retainer plate 17 are provided between the rear housing and the cylinder block 11.

A crank chamber 121 is defined in the front housing 12. A drive shaft 18 extends through the front housing 12 and the cylinder block 11 and is rotatably supported. The front end of the drive shaft 18 projects outward from the housing 12. A pulley 19 is secured to the projecting end of the drive shaft 18. The pulley 19 is operably connected to a vehicle engine (not shown) by a belt 20. The front housing 12 supports the pulley 19 by means of an angular bearing 21. The angular bearing 21 receives both axial and radial loads that are applied to the front housing 12 by the pulley 19.

A lug plate 22 is connected to the drive shaft 18. A disk-like swash plate 23 is provided on the drive shaft 18. The swash plate 23 is inclinable and slidable in the axial direction of the drive shaft 18. A shaft hole 231 extends through the center of the swash plate 23. The drive shaft 18 is inserted through the shaft hole 231 to enable relative sliding between the swash plate 23 and the shaft 18. The middle of the shaft hole 231 in the axial direction of the drive shaft 18 has a substantially circular cross-section. The diameter at the middle (circular portion) of the shaft hole 231 is about the same as the diameter of the drive shaft 18. The shaft hole 231 is flared toward the rear side of the swash plate 23 (toward the cylinder block 11) from the circular portion. The shaft hole 231 is also flared toward the front side of the swash plate 23 (toward the front housing 12) from the circular portion. The shape of the shaft hole 231 enables the swash plate to slide and incline with respect to the drive shaft 18 without interference.

Figure 3:
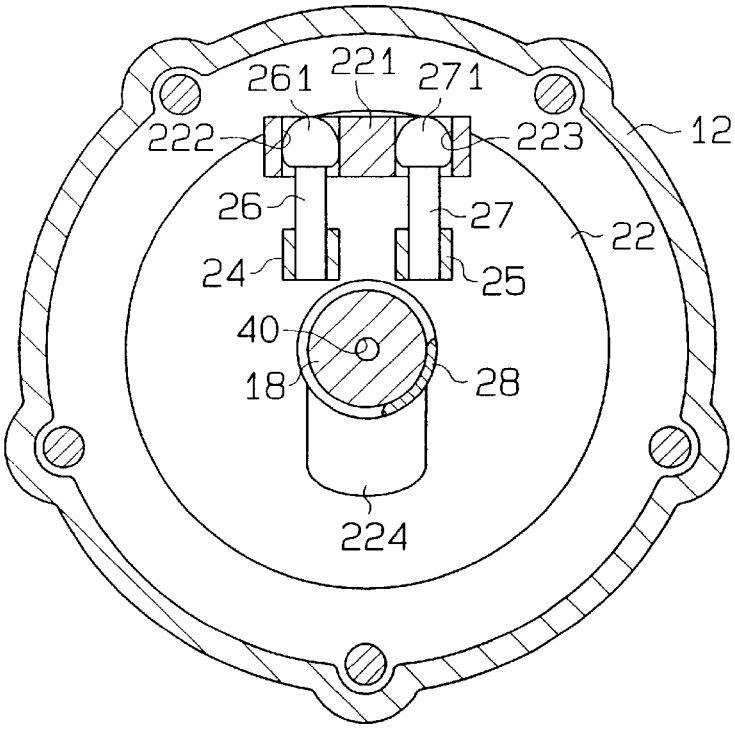
FIG. 3 is a cross-sectional view taken along line 3—3 in FIG. 1.

As shown in FIG. 3, coupling pieces 24, 25 are fixed to the swash plate 23. Guide pins 26, 27 are secured to the coupling pieces 24, 25, respectively. Guide spheres 261, 271 are provided at the distal end of the guide pins 26, 27. An arm 221 projects from the lug plate 22. A pair of guide holes 222, 223 are defined in the arm 221. The guide spheres 261, 271 are slidably fitted into the guide holes 222, 223, respectively. The arm 221 cooperates with the pair of guide pins 26, 27 to permit the swash plate 23 to incline in the axial direction of the drive shaft 18 and to integrally rotate the swash plate 23 with the drive shaft 18.

The guide spheres 261, 271 are guided in the associated guide holes 222, 223 as the guide spheres 261, 271 slide therein while the swash plate 23 is supported by the drive shaft 18 as the plate 23 slides along the shaft 18. During its inclination, the swash plate 23 inclines about its upper section, as viewed in FIG. 1, which is where the piston 37 is moved to a top dead center position. The inclination of the swash plate 23 with respect to a direction perpendicular to the drive shaft 18 becomes small as the center of the swash plate moves toward the cylinder block 11.

Figure 2:
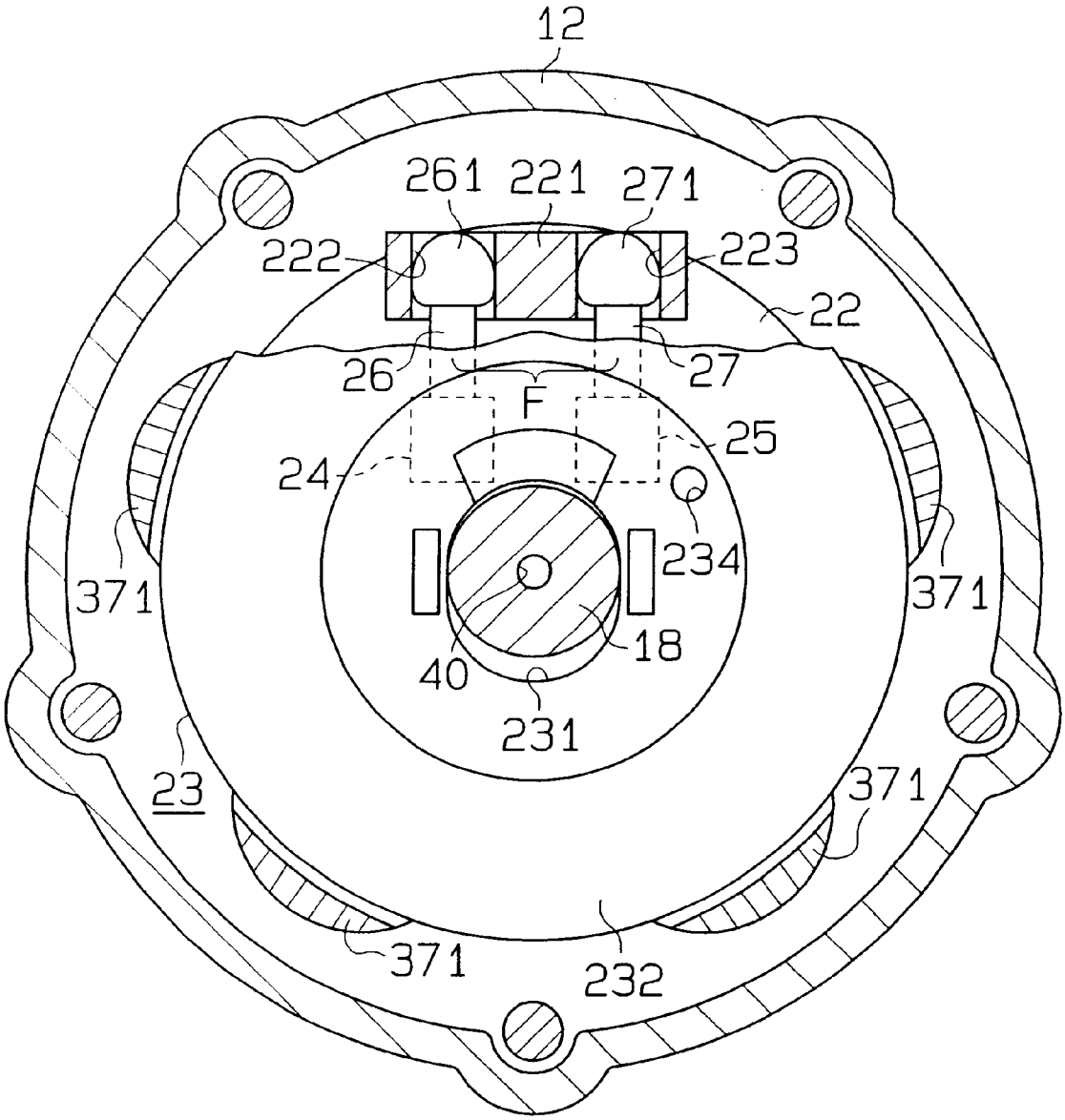
FIG. 2 is a cross-sectional view taken along line 2—2 in FIG. 1.

Annular sliding surfaces 232, 233 are defined at the periphery of the front and rear sides of the swash plate 23. A reference hole 234 extends in a direction perpendicular to the sliding surfaces 232, 233 at a location that is inward from the sliding surfaces 232, 233. As shown in FIG. 2, the reference hole 234 is located at a position spaced from the region located between the guide pins 26, 27.

Figure 6:
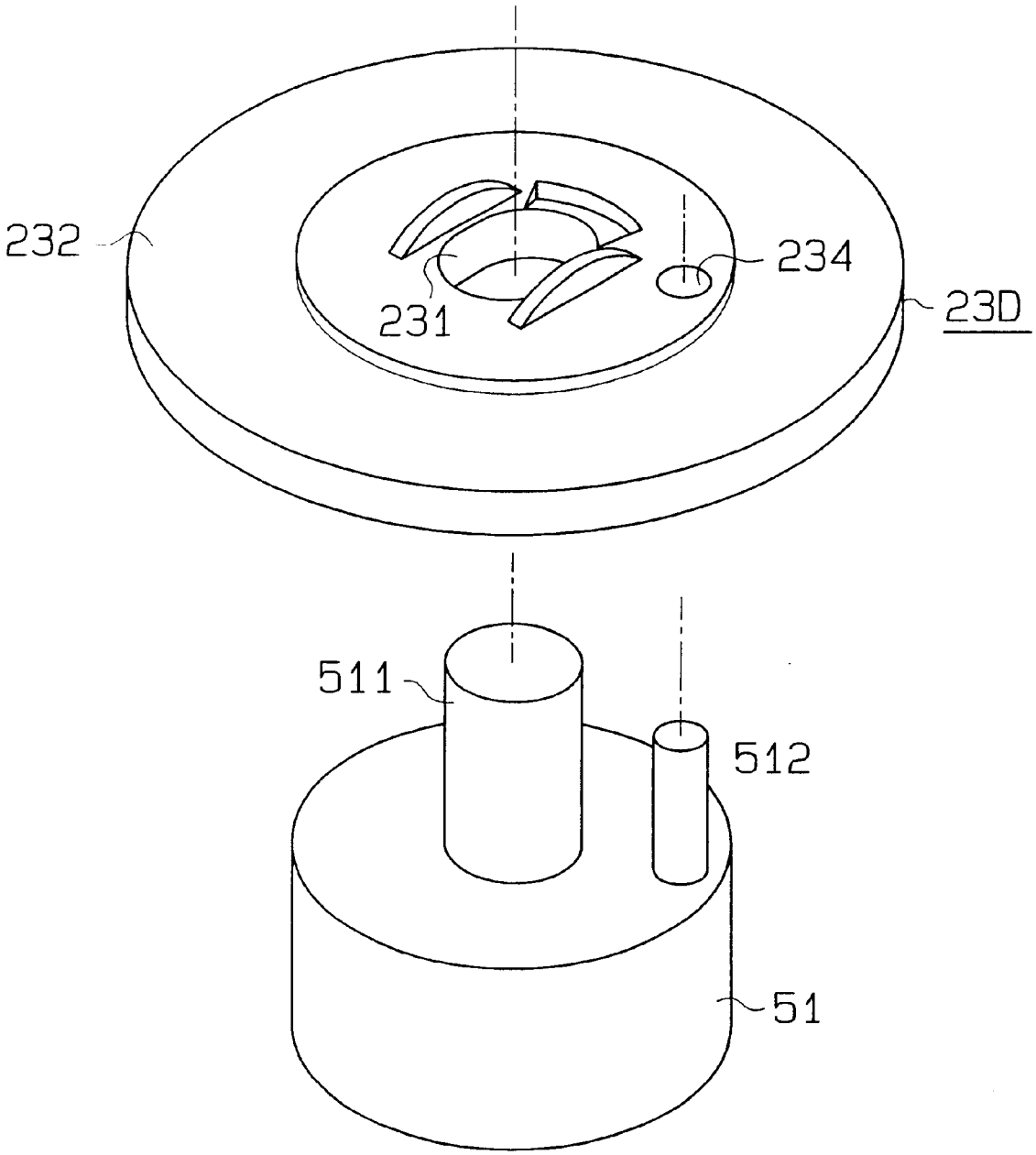
FIG. 6 is a perspective view showing the manufacturing method of the swash plate.

The reference hole 234 is used to grind the swash plate 23. For example, the reference hole 234 is used when grinding the sliding surfaces 232, 233. As shown in FIG. 6, the swash plate 23 is produced from a cast, disk-like workpiece 23D. The shaft hole 231 and the reference hole 234 are formed when casting the workpiece 23D. The workpiece 23D is ground by first securing the workpiece 23 to a jig 51. A center shaft 511 and a positioning pin 512 project from the jig 51. The center shaft 511 is inserted into the shaft hole 23 while the positioning pin 512 is inserted into the reference hole 23D. Accordingly, the workpiece 23D is supported at two locations on the jig 51. This prevents the workpiece 23D from rotating with respect to the jig 51. The jig 51 is fixed to a table of a numerically controlled (NC) milling machine (not shown). The peripheral portion on one side of the workpiece 23D is ground by a grinding stone (not shown) attached to the NC grinding machine to finish the sliding surface 232 of the swash plate 23. After the sliding surface 232 is finished, the workpiece 23D is reversed on the jig 51 and ground again to form the sliding surface 233.

A compression spring 28 is arranged between the lug plate 22 and the swash plate 23. The spring 28 urges the swash plate 23 in a direction that decreases the inclination of the swash plate 23.

Figure 5:
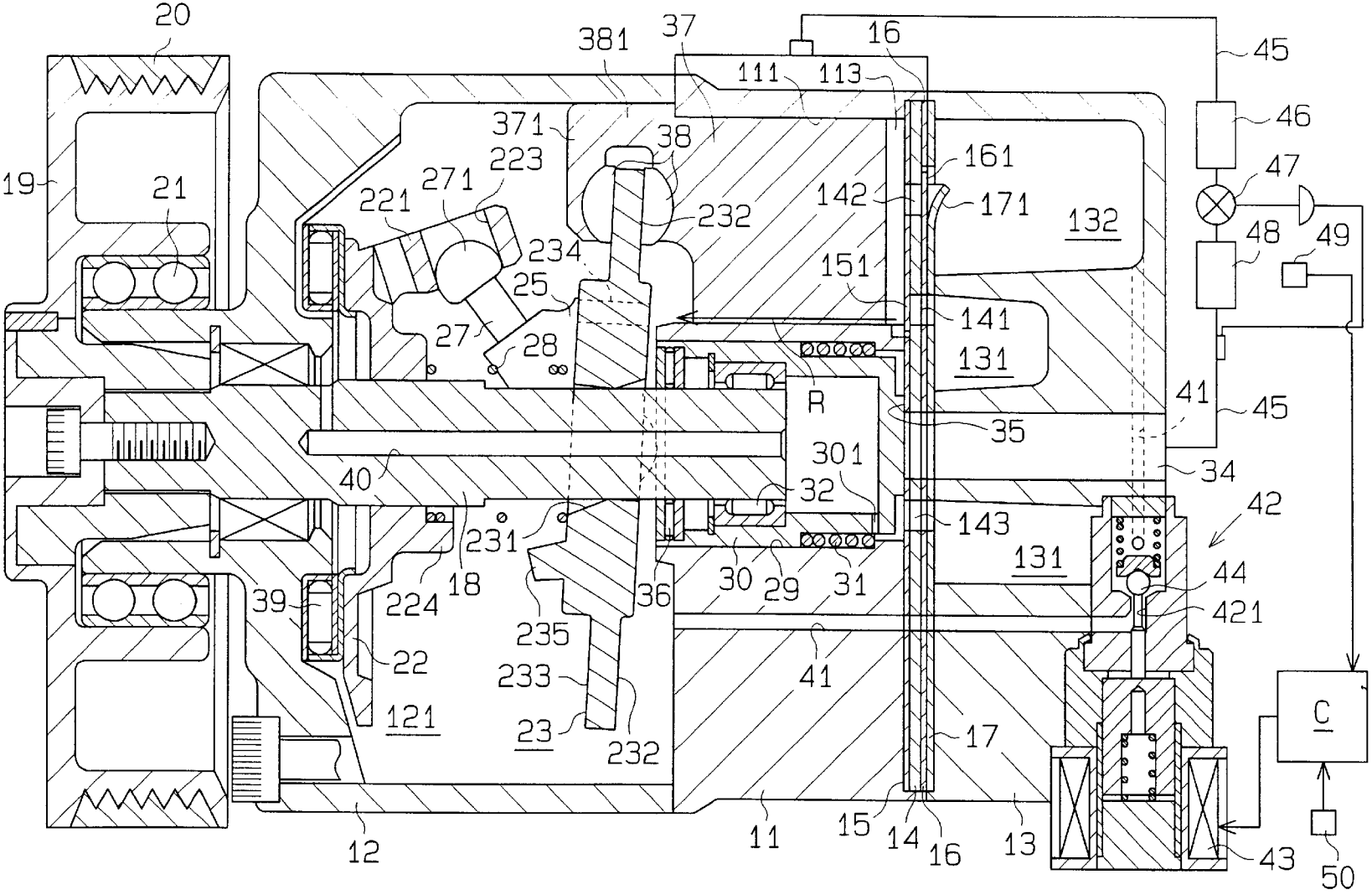
FIG. 5 is a cross-sectional side view showing the entire compressor when the swash plate is arranged at the minimum inclination position.

As shown in FIGS. 1 and 5, an accommodating hole 29 extends through the center of the cylinder block 11 in the axial direction of the drive shaft 18. A cup-like plunger 30 is slidably accommodated in the accommodating hole 29. A compression spring 31 is arranged between the plunger 30 and an end step of the accommodating hole 29. The spring 31 urges the plunger 30 toward the swash plate 23.

The rear end of the drive shaft 18 is inserted into the plunger 30. A radial bearing 32 is supported by the inner surface of the plunger 30. The radial bearing 32 is slidable with respect to the drive shaft 18. A snap ring 33 is arranged in the plunger 30 to prevent the radial bearing 32 from falling out of the plunger 30. The rear end of the drive shaft 18 is supported by the wall of the accommodating hole 29 by means of the radial bearing 32 and the plunger 30.

A suction passage 34 extends through the center of the rear housing 13. The axis of the suction passage 34 coincides with the axis of the plunger 30. The suction passage 34 is connected with the accommodating hole 29. A positioning surface 35 is defined about the opening of the suction passage 34 on the valve plate 15. The end face of the plunger 30 abuts against the positioning surface 35. The abutment between the plunger 30 and the positioning surface 35 restricts the plunger 30 from moving further away from the swash plate 23.

A thrust bearing 36 is slidably arranged on the drive shaft 18 between the swash plate 23 and the plunger 30. The force of the spring 31 keeps the thrust bearing 36 held between the swash plate 23 and the plunger 30. As the swash plate 23 moves toward the plunger 30, the inclination of the swash plate 23 is conveyed to the plunger 30 by means of the thrust bearing 36. This moves the plunger 30 toward the positioning surface 35 against the force of the spring 31 until the plunger 30 abuts against the positioning surface 35. The thrust bearing 36 prevents the rotation of the swash plate 23 from being conveyed to the plunger 30.

A plurality of cylinder bores 111 extend through the cylinder block 11. A single-headed piston 37 is accommodated in each cylinder bore 111. Each piston 37 is coupled to the swash plate 23 by shoes 38. The rotating movement of the swash plate 23 is converted to reciprocating movement of each piston 37 by means of the shoes 38. This moves the piston 37 back and forth in each cylinder bore 111.

Figure 4:
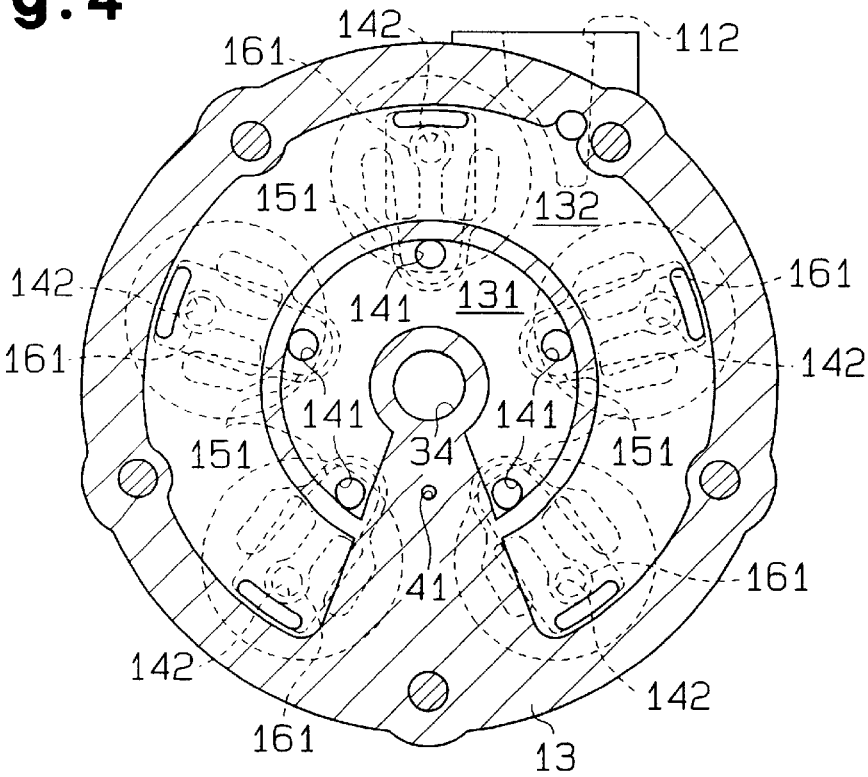
FIG. 4 is a cross-sectional view taken along line 4—4 in FIG. 1.

As shown in FIGS. 1 and 4, a suction chamber 131 and a discharge chamber 132 are defined in the rear housing 13. Suction ports 141 and discharge ports 142 are defined in the first valve plate 14. Suction valves 151 are provided in the second valve plate 15. Discharge valves 161 are provided in the third valve plate 16. When each piston 37 moves away from the valve plates 14, 15, 16, the refrigerant gas in the suction chamber 131 opens the associated suction valve 151 and enters the compression chamber 113 defined in the cylinder bore 111 through the associated suction port 141. When the piston 37 moves toward the valve plates 14, 15, 16, the refrigerant gas in the compression chamber 113 is compressed and then discharged into the discharge chamber 132 through the associated discharge port 142 as the gas opens the associated discharge valve 161. When opened, the discharge valve 161 abuts against a retainer 171 provided on the retainer plate 17. This restricts the opening of the discharge valve 161.

A thrust bearing 39 is arranged between the lug plate 22 and the front housing 12. The thrust bearing 39 receives the compression reaction that is produced in each compression chamber 113 and applied to the lug plate 22 by way of the piston 37, the shoes 38, the swash plate 23, the coupling pieces 24, 25, and the guide pins 26, 27. Accordingly, heavy load resulting from the compression reaction acts on the sliding surface 232 of the swash plate 23. The region on the swash plate 23 that receives the heaviest load is denoted as F in FIGS. 1 and 2.

The maximum reaction force is applied to the swash plate 23 at a location that is offset in the rotating direction of the swash plate 23 for a predetermined angle from the portion of the swash plate 23 that moves the pistons to the 37 top dead center position. The degree of the offset angle varies in accordance with the rotating speed and the compression ratio of the compressor. Accordingly, it is preferable that the guide pins 26, 27 be arranged so as to straddle the region at which the maximum reaction force varies. The region F corresponding to the region between the two guide pins 26, 27 is defined as a heavy load region. As described above, the heavy load region F is offset in the rotating direction of the swash plate 23 from the portion corresponding to the top dead center position. However, the swash plate 23 employed in the present invention is rotated in both forward and reverse directions. Thus, the two guide pins 26, 27 are located symmetrically with respect to a plane that includes the axis of the rotary shaft 18 and intersects the portion on the swash plate 23 corresponding to the top dead center position.

The suction chamber 131 is connected with the accommodating hole 29 through an inlet 143. When the plunger 30 abuts against the positioning surface 35, the inlet 143 becomes disconnected from the suction passage 34. A conduit 40 extends through the drive shaft 18. The crank chamber 121 is connected to the inside of the plunger 30 through the conduit 40. As shown in FIGS. 1 and 5, a pressure releasing hole 301 extends through the wall of the plunger 30. The inside of the plunger 30 is connected to the accommodating hole 35 by the pressure releasing hole 301.

As shown in FIG. 1, the discharge chamber 132 is connected to the crank chamber 121 by a pressurizing passage 41. An electromagnetic valve 42 is provided in the pressurizing passage 41. The valve 42 includes a solenoid 43, a valve body 44, and a valve hole 421. When the solenoid 43 is excited, the valve body 44 closes the valve hole 421. When the solenoid 43 is de-excited, the valve body 44 opens the valve hole 421. In this manner, the valve 42 selectively connects and disconnects the discharge chamber 132 with the crank chamber 121.

The suction passage 34, through which refrigerant gas is drawn in, and an outlet 112 of the discharge chamber 132, from which the refrigerant gas is discharged, are connected to each other by an external refrigerant circuit. The external refrigerant circuit 45 is provided with a condenser 46, an expansion valve 47, and an evaporator 48. The expansion valve 47 controls the flow rate of the refrigerant in accordance with changes in the gas temperature at the outlet side of the evaporator 48. A temperature sensor 49 is provided in the vicinity of the evaporator 48. The temperature sensor 49 detects the temperature of the evaporator 48 and sends a signal corresponding to the detected temperature to a computer C.

In response to the signal from the temperature sensor 49, the computer C excites or de-excites the solenoid 43. When an operating switch 50 is turned on, the computer C de-excites the solenoid 43 if the temperature detected by the temperature sensor 49 becomes lower than a predetermined value. The predetermined temperature corresponds to a temperature at which frost may start forming in the evaporator 48. When the operating switch 50 is turned off, the computer C de-excites the solenoid 43.

In the state shown in FIG. 1, the solenoid 43 is excited and the pressurizing passage 41 is thus closed. Accordingly, the flow of high-pressure refrigerant gas from the discharge chamber 132 to the crank chamber 121 is impeded. In this state, the refrigerant gas in the crank chamber 121 continuously flows into the suction chamber 131 by way of the conduit 40 and the pressure releasing hole 301. This lowers the pressure in the crank chamber 121 until it becomes close to the low pressure in the suction chamber 131 (i.e., suction pressure). This increases the inclination of the swash plate 23. When the swash plate 23 inclines to a maximum inclination position, a balance weight 235 provided integrally with the swash plate 23 abuts against a projection 224 projecting from the lug plate 22. This restricts further movement of the swash plate 23 from the maximum inclination position. When the swash plate 23 is held at the maximum inclination position, the compressor displacement becomes maximum.

When the ambient temperature decreases, the load of the compressor becomes small. If the swash plate 23 is held at the maximum inclination position in this state, the temperature of the evaporator 48 falls and becomes close to a temperature at which frost starts forming. The temperature sensor 49 sends a signal corresponding to the temperature of the evaporator 48 to the computer C. When the temperature becomes lower than the predetermined temperature, the computer C de-excites the solenoid 43. This opens the pressurizing passage 41 and connects the discharge chamber 132 with the crank chamber 121. Accordingly, the high-pressure refrigerant gas in the discharge chamber 132 is drawn into the crank chamber 121 through the pressurizing passage 41. This increases the pressure in the crank chamber 121. The pressure increase in the crank chamber 121 shifts the swash plate 23 to a minimum inclination position. The swash plate 23 is also shifted to the minimum inclination position when the switch 50 is turned off and the solenoid 43 is de-excited by the computer C.

When the inclination of the swash plate 23 becomes minimum, the plunger 30 abuts against the positioning surface 35 and closes the suction passage 34. Since the swash plate 23 inclines gradually and moves the plunger 30 accordingly, the plunger 30 serves to restrict the flow of the gas passing through the suction passage 34. Thus, the flow rate of the refrigerant gas flowing from the suction passage 34 to the suction chamber 131 gradually becomes small as the effective cross-sectional area of the passage therebetween decreases. This gradually decreases the amount of refrigerant gas drawn into each compression chamber 113 from the suction chamber 131. Accordingly, the discharge pressure gradually becomes smaller and the load torque of the compressor is prevented from changing suddenly. As a result, the change in load torque of the compressor is small when the compressor displacement is shifted from maximum to minimum. This eliminates shocks that may be produced by changes in the load torque.

As shown in the state of FIG. 5, when the plunger 30 abuts against the positioning surface 35, the suction passage 34 is completely closed. Hence, the flow of refrigerant gas from the external refrigerant circuit 45 to the suction chamber 131 is impeded. In other words, the circulation of the refrigerant in the external refrigerant circuit 45 is stopped. The minimum inclination position of the swash plate 23 is restricted by the abutment between the plunger 30 and the positioning surface 35.

When located at the minimum inclination position, the inclination of the swash plate 23 with respect to a plane perpendicular to the drive shaft 18 is slightly greater than zero degrees. The swash plate 23 is located at the minimum inclination position when the plunger 30 is arranged at a closing position at which the plunger 30 disconnects the suction passage 34 from the accommodating hole 29. The plunger 30 cooperates with the swash plate 23 and moves between the closing position and an opening position. Since the minimum inclination of the swash plate 23 is slightly greater than zero degrees, discharge of refrigerant gas from each compression chamber 113 to the discharge chamber 132 continues even when the swash plate 23 is located at the minimum inclination position. The refrigerant gas discharged into the discharge chamber 121 from the compression chambers 113 passes through the pressurizing passage 41 and flows into the crank chamber 121. The refrigerant gas in the crank chamber 121 flows into the suction chamber 131 by way of the conduit 40 and the pressure releasing hole 301. The refrigerant gas in the compression chamber 131 is drawn into each compression chamber 113 and discharged into the discharge chamber 132. In other words, a circulation passage of the refrigerant gas is defined in the compressor when the swash plate 23 is located at the minimum inclination position. The circulation passage extends between the discharge chamber 132 (discharge pressure zone), the pressurizing passage 41, the crank chamber 121, the conduit 40, the pressure releasing hole 301, the accommodating hole 29 (suction pressure zone), the suction chamber 131 (suction pressure inzone), and the compression chambers 113. The pressure in the discharge chamber 132, the crank chamber 121, and the suction chamber 131 differs from one another. This enables the refrigerant gas to circulate through the circulation passage. The circulating refrigerant gas lubricates the interior of the compressor with the lubricating oil suspended therein.

A clearance is defined between each piston 37 and the wall of the associated cylinder bore 111. As indicated by the arrow R in FIG. 5, the refrigerant gas in the compression chamber 113 leaks into the crank chamber 121 during the discharge stroke of the piston 37. Part of the lubricating oil, which is suspended in the refrigerant gas passing through the clearance, lubricates the area of contact between the swash plate 23 and the shoes 38.

When the ambient temperature increases in the state shown in FIG. 5, the load of the compressor becomes large. This increases the temperature of the evaporator 48. If the temperature of the evaporator 48 exceeds a predetermined temperature, the computer C excites the solenoid 43. This causes the electromagnetic valve 42 to close the pressurizing passage 41. Accordingly, the pressure in the crank chamber 121 is released through the conduit 40 and the pressure releasing hole 301. This decreases the pressure in the crank chamber 121 and extends the spring 31 from the compressed state shown in FIG. 5. The spring 31 separates the plunger 30 from the positioning surface 35 and increases the inclination of the swash plate 23 from the minimum inclination position. As the plunger 30 moves away from the positioning surface 35, the flow rate of the refrigerant gas drawn into the suction chamber 131 from the suction passage 34 gradually increases as the effective cross-sectional area of the passage therebetween increases. Accordingly, the 19 amount of refrigerant gas drawn into each compressing chamber 113 from the suction chamber 131 increases gradually. This, in turn, gradually increases the compressor displacement. Hence, the load torque of the compressor is not changed suddenly. As a result, the change in load torque of the compressor is small when the compressor displacement is shifted from minimum to maximum. This eliminates shocks that may be produced by changes in the load torque.

When the vehicle engine is stopped, the rotation of the swash plate 23 is stopped and the compressor is deactivated. The electromagnetic valve 42 is concurrently de-excited and the inclination of the swash plate 23 becomes minimum. Although the pressure in the compressor becomes uniform when the compressor remains deactivated, the swash plate 23 is maintained held at the minimum inclination position by the force of the spring 28. Accordingly, when the starting of the engine commences operation of the compressor, the swash plate 23 begins to rotate at the minimum inclination position. Since the load torque is minimum when the swash plate 23 is located at the minimum inclination position, the shock, which is produced when commencing operation of the compressor, is minimal.

As described above, the refrigerant gas in each compression chamber 132 leaks into the crank chamber 121 through the clearance defined between each piston 37 and the wall of the associated cylinder bore 111. Each piston 37 has a basal portion 381 that is defined at the periphery of the cylinder block 121 to couple the sliding surfaces 232, 233 of the swash plate 23 with the shoes 38. This causes the refrigerant gas to leak mainly through the portion of the clearance that is closer to the center of the cylinder block 121, as indicated by arrow R in FIG. 5. Part of the refrigerant oil that leaks from the clearance, advances along the swash plate 23 toward the sliding surface 232. This allows the refrigerant gas to be supplied to the heavy load region F, at which the compression reaction force is heaviest on the sliding surface 232. In other words, refrigerant gas is supplied to the portion corresponding to the region between the two guide pins 26, 27. The reference hole 234 is offset angularly with respect to the guide pins 26, 27. Thus, the flow of refrigerant gas from the center portion of the swash plate 23 toward the heavy load region F on the sliding surface 232 is not obstructed by the reference hole 234. Accordingly, the reference hole 234 does not hinder the lubrication of the heavy load region F.

In addition, the reference hole 234 does not extend through either one of the guide pins 26, 27 and the coupling pieces 24, 25. Thus, the strength of the guide pins 26, 27 and the coupling pieces 24, 25 remains unafected.

When the circulation of refrigerant through the external refrigerant circuit 45 is stopped, the inclination of the swash plate 23 becomes minimum. If the circulation of the refrigerant is commenced, the inclination of the swash plate 23 is increased. The swash plate 23 is constantly rotated when the external drive source is operating. Thus, the heavy load region F defined on the sliding surface 232 between the swash plate 23 and the shoes 38 must be lubricated even when the swash plate 23 is located at the minimum inclination position, that is, when the compressor displacement is minimum. When the compressor displacement is minimum, the refrigerant in the external refrigerant circuit is not returned to the compressor. In this state, the heavy load region F on the sliding surface 232 is lubricated solely by the lubricating oil suspended in the refrigerant circulating within the compressor. Accordingly, in the swash plate 23 provided with the reference hole 234 at the location described above, the lubrication of the heavy load region F is not hindered by the reference hole. This structure is especially effective in clutchless compressors.

Figure 7:
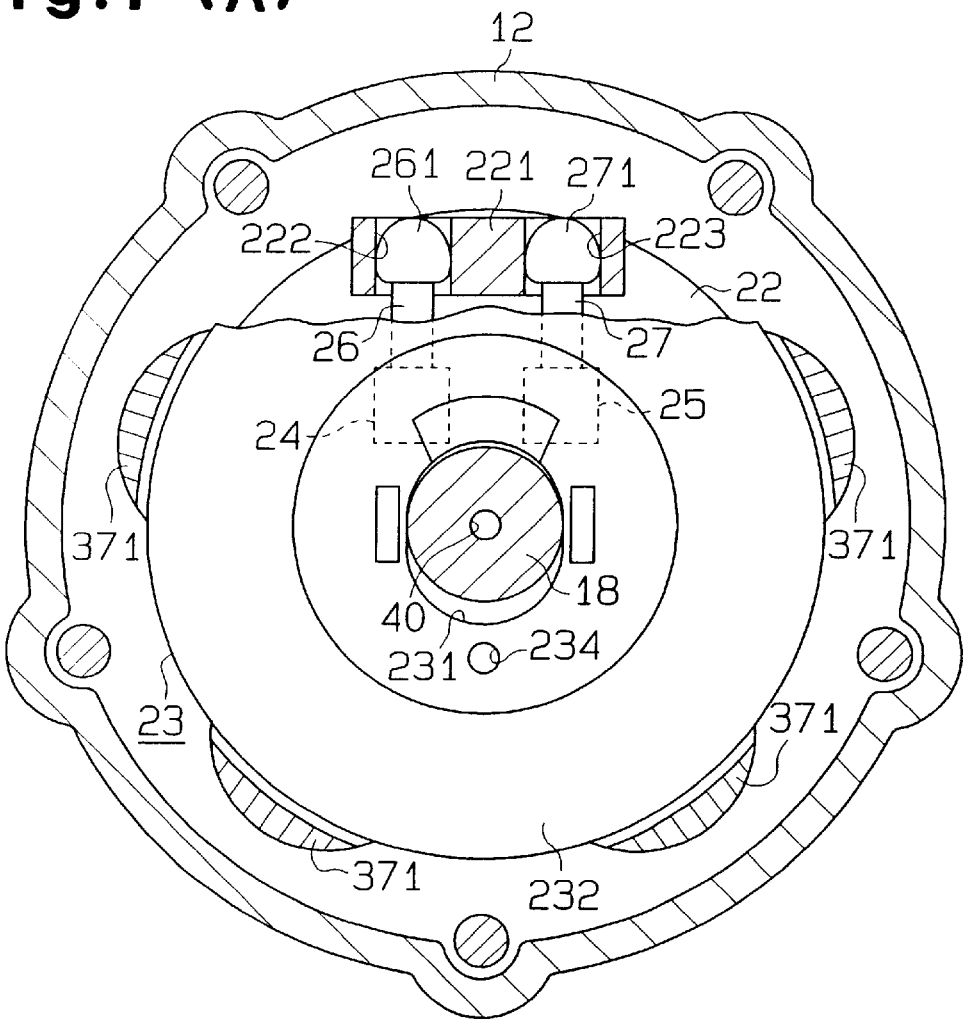
FIGS. 7(A) and 7(B) show a second embodiment according to the present invention.
Figure 7:
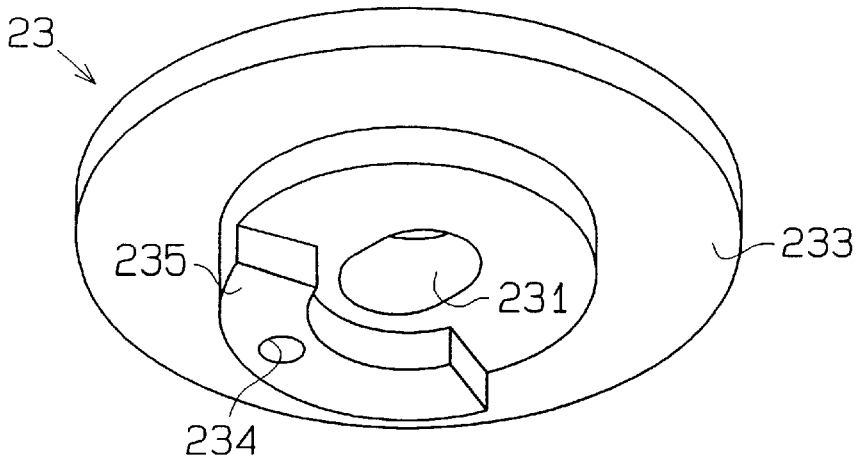

A second embodiment according to the present invention will now be described with reference to FIGS. 7(A) and 7(B). Elements that are identical to those employed in the first embodiment will be denoted with the same reference numerals. In this embodiment, the reference hole 234 extends through the swash plate 23 on the opposite side of the shaft hole 231 with respect to the guide pins 26, 27. The reference hole 234 extends through the balance weight 235. Since the reference hole 234 is located at a position farthest from the heavy load region F, which is on the other side of the drive shaft 18, the effect that the reference hole 234 has on the lubrication of the heavy load region F is minimal.

Furthermore, the reference hole 234 extends through the balance weight 235. It is necessary to limit the diameter of the reference hole 234 to ensure the required strength in the swash plate 23. However, in the swash plate 23, the strength is highest at the location of the balance weight 235. Thus, by providing the reference hole 234 in the balance weight 235, the diameter of the reference hole 234 may be changed without having to worry about the strength of the swash plate 23.

Figure 8:
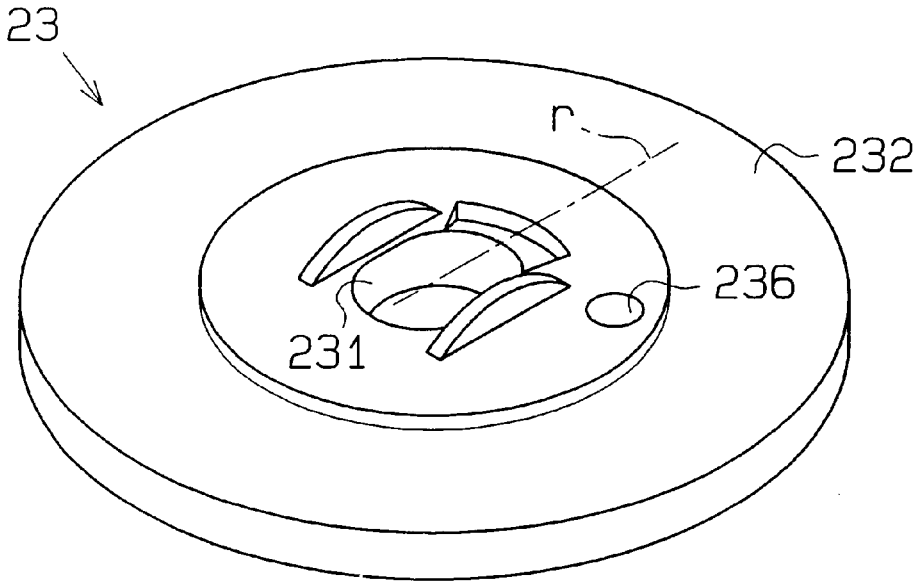
FIGS. 8(A) and 8(B) show a third embodiment according to the present invention.
Figure 8:
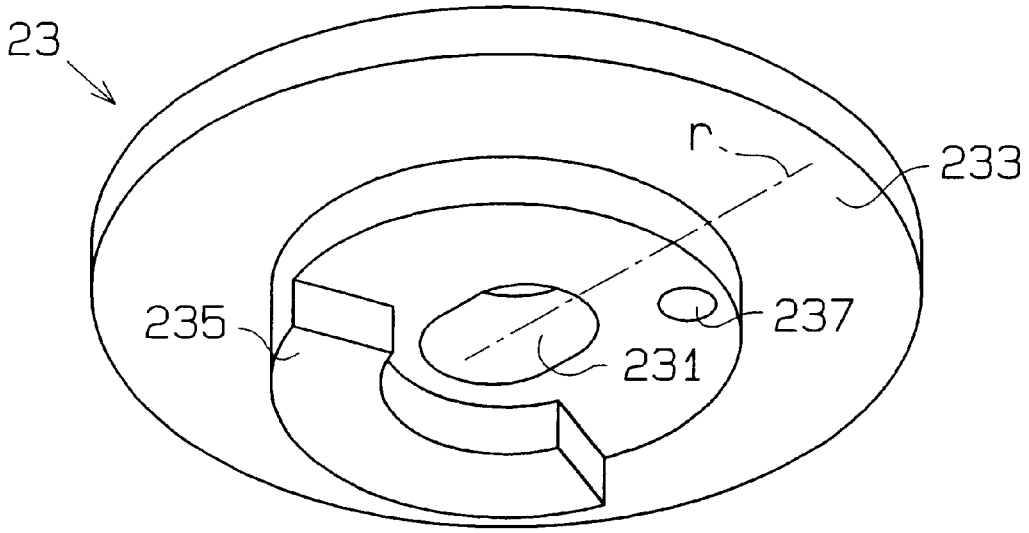

A third embodiment according to the present invention will now be described with reference to FIGS. 8(A) and 8(B). Elements that are identical to those employed in the first embodiment will be denoted with the same reference numerals.

In this embodiment, a reference hole 236 is provided in the front side of the swash plate 23 while another reference hole 237 is provided in the rear side of the swash plate 23. Each reference hole 236, 237 is a blind hole that does not extend through the swash plate 23. The reference holes 236, 237 are located symmetrically with respect to a radial line r, which extends from the axis of the swash plate 23 to the middle point between the guide pins 26, 27. In this embodiment, the lubrication of the heavy load region F is substantially unaffected by the reference holes 236, 237 since they do not extend through the swash plate 23.

Figure 9:
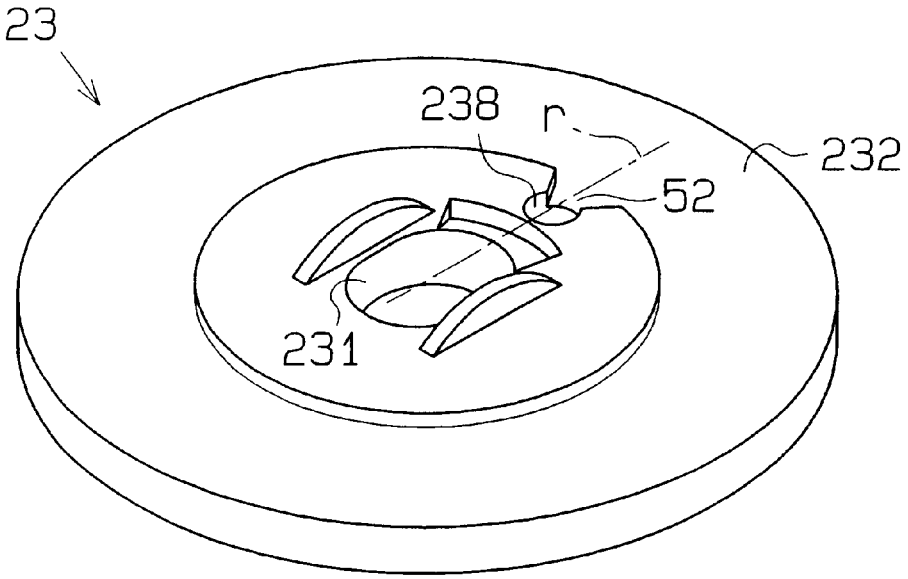
FIGS. 9(A) and 9(B) show a fourth embodiment according to the present invention.
Figure 9:
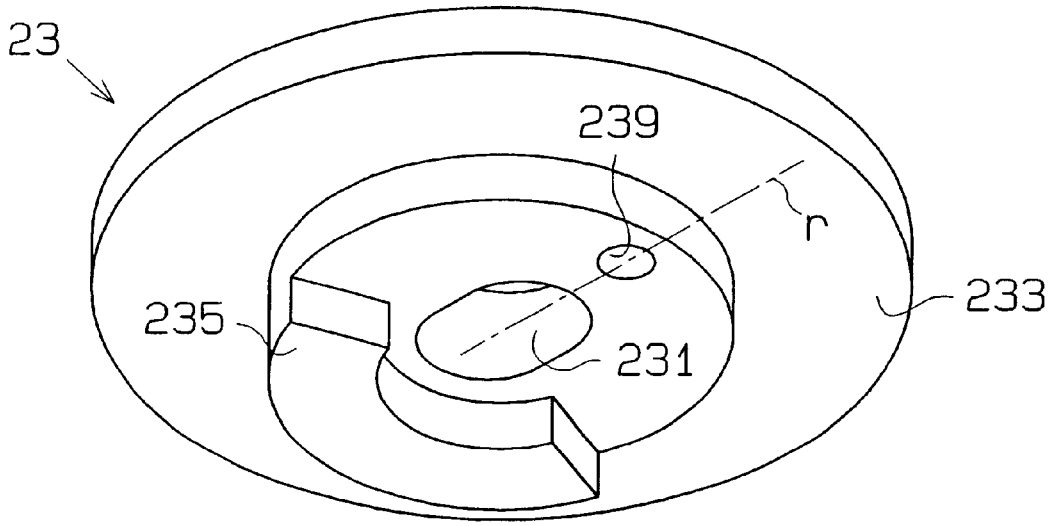

A fourth embodiment according to the present invention will now be described with reference to FIGS. 9(A) and 9(B). Elements that are identical to those employed in the first embodiment will be denoted with the same reference numerals.

In this embodiment, a reference hole 238 is provided in the front side of the swash plate 23 while a reference hole 239 is provided in the rear side of the swash plate 23. Each reference hole 238, 239 is a blind hole that does not extend through the swash plate 23. Each reference hole 238, 239 is provided along the radial line r. A guide groove 52 connecting the reference hole 238 and the sliding surface 232 is provided on the rear side of the swash plate 23. The reference hole 238 and the guide groove 52 guide the flow of refrigerant gas that leaks into the crank chamber 121 from the compression chambers 113 toward the heavy load region F on the sliding surface 232. In the same manner as the third embodiment, the lubrication of the heavy load region F on the sliding surface 232 is substantially unaffected by the reference holes 238, 239 since they do not extend through the swash plate 23. Furthermore, since the guide groove 52 guides the refrigerant gas, lubrication of the heavy load region F on the sliding surface 232 is facilitated.

The present invention is applied to clutchless variable displacement compressors in the above embodiments. However, the present invention may also be applied to variable displacement compressors that have clutches.

Although several embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. An improved lubricating structure of a compressor including a drive shaft rotatably tiltably supported in a crank chamber, a swash plate supported on the drive shaft for an integral rotation therewith and a piston operably coupled to the swash plate, the rotation of the swash plate being converted to a reciprocal movement of the piston in a cylinder bore to compress and discharge gas, wherein said gas contains oil, said structure comprising:

said cylinder bore having an inner peripheral surface;

said piston having an outer peripheral surface;

said inner peripheral surface and said outer peripheral surface defining a clearance therebetween;

said swash plate having a bore for attaching the swash plate to a jig when the swash plate is ground during its manufacturing process;

said swash plate having an operation area receiving a greatest compression load when the swash plate rotates; and said bore being arranged to allow the gas flow out from the cylinder bore through the clearance to flow to the operation area.

2. The lubricating structure as set forth in claim 1, wherein said bore is formed in a position radially offset with respect to the operation area.

3. The lubricating structure as set forth in claim 2, wherein said bore extends through the swash plate.

4. The lubricating structure as set forth in claim 2 further comprising a shoe interposed between the swash plate and the piston, said shoe contacting the piston and the operation area of the swash plate.

5. The lubricating structure as set forth in claim 4 further comprising:

means for tiltably supporting the swash plate; and said operation area being located in a position on the swash plate corresponding to the tiltably supporting means along an axial direction with respect to the drive shaft.

6. The lubricating structure as set forth in claim 5, wherein said tiltably supporting means comprises:

a pair of guide pins extending parallel to one another from the swash plate; and a lug plate supported on the drive shaft for integral rotation therewith and loosely supporting said guide pins.

7. The lubricating structure as set forth in claim 6 further comprising a balance weight in one of opposed surfaces of the swash plate, said balance weight being distant from the operation area; and said bore being dented in the balance weight.

8. The lubricating structure as set forth in claim 1 further comprising:

a pair of guide pins extending parallel to one another from the swash plate;

a lug plate supported on the drive shaft for integral rotation therewith and loosely supporting said guide pins;

said guide pins and said lug plate tiltably supporting the swash plate;

said swash plate including opposed surfaces and a pair of bores respectively dented in the surfaces; and said bores being formed symmetrically with respect to a line intersecting a rotating center of the swash plate and a mid point between the guide pins.

9. The lubricating structure as set forth in claim 1 further comprising:

a pair of guide pins extending parallel to one another from the swash plate;

a lug plate supported on the drive shaft for integral rotation therewith and loosingly supporting said guide pins;

said guide pins and said lug plate tiltably supporting the swash plate;

said swash plate including opposed surfaces and a pair of bores respectively dented in the opposed surfaces; and a passage that connects at least one of said bores to the operation area to guide the gas to the operation area from the bore.

10. An improved lubricating structure of a compressor including a drive shaft rotatably supported in a crank chamber, a swash plate supported on the drive shaft for integral rotation therewith and a piston movably disposed in a cylinder bore and operably coupled to the swash plate, the rotation of the swash plate being converted to a reciprocal movement of the piston by a stroke based on an inclining angle of the swash plate between a maximum inclining angle and a minimum inclining angle to compress and discharge refrigerant gas, wherein said refrigerant gas contains oil, and wherein said inclining angle of the swash plate is controlled by a difference between a reaction force of the compressed gas acting on an end surface of the piston and pressure in the crank chamber, said structure comprising:

an operation area of said swash plate receiving greatest load based on the reaction force of compressed gas acting on the piston when the swash plate rotates; and said cylinder bore having an inner peripheral surface;

said piston having an outer peripheral surface;

said inner peripheral surface and said outer peripheral surface defining a clearance therebetween;

said swash plate having a bore for attaching the swash plate to a jig when the swash plate is ground during its manufacturing process; and said bore being arranged to allow the refrigerant gas flow out from the cylinder bore through the clearance to flow to and lubricate the operation area.

11. The lubricating structure as set forth in claim 10 further comprising:

a pair of guide pins extending parallel to one another from the swash plate;

a lug plate supported on the drive shaft for an integral rotation therewith and loosingly supporting said guide pins;

said guide pins and said lug plate tiltably supporting the swash plate;

said operation area being located in a position in the swash plate corresponding to the tiltably supporting means along an axial direction with respect to the drive shaft; and a shoe interposed between the swash plate and the piston, said shoe contacting the piston and the operation area of the swash plate.

12. The lubricating structure as set forth in claim 11, wherein said bore is formed in a position radially offset with respect to the operation area.

13. The lubricating structure as set forth in claim 11, wherein said bore extends through the swash plate.

14. The lubricating structure as set forth in claim 11, wherein said bore is dented in the swash plate.

15. The lubricating structure as set forth in claim 11 further comprising a balance weight in one of opposed surfaces of the swash plate, said balance weight being distant from the operation area; and said bore being dented in the balance weight.

16. The lubricating structure as set forth in claim 11 further comprising:

said swash plate including opposed surfaces and a pair of bores respectively dented in the opposed surfaces; and said bores being formed symmetrically with respect to a line intersecting a rotating center of the swash plate and a mid point between the guide pins.

17. The lubricating structure as set forth in claim 11 further comprising:

said swash plate including opposed surfaces and a pair of bores respectively dented in the opposed surfaces; and a passage that connects at least one of said bores to the operation area to guide the gas to the operation area from the bore.

18. The lubricating structure as set forth in claim 11, wherein said minimum inclining angle of the swash plate is slightly greater than zero degree so as to circulate the refrigerant gas within the compressor and lubricate the interior of the compressor.

19. An improved lubricating structure of a clutch-less type compressor including a drive shaft rotatably supported in a crank chamber, a swash plate supported on the drive shaft for integral rotation therewith and a piston movably disposed in a cylinder bore and operably coupled to the swash plate, the rotation of the swash plate being converted to a reciprocal movement of the piston by a stroke in a compression chamber defined by an end surface of the piston and a wall of the cylinder bore opposite to the end surface, said piston stroke being based on an inclining angle of the swash plate between a maximum inclining angle and a minimum inclining angle to compress refrigerant gas introduced from an external circuit to the compression chamber via a suction chamber and discharge the refrigerant gas to a discharge chamber from the compression chamber, wherein said refrigerant gas contains oil, and wherein said inclining angle of the swash plate is controlled by a difference between a reaction force of the compressed gas acting on the end surface of the piston and pressure in the crank shaft, said structure comprising:

a pair of guide pins extending parallel to one another from the swash plate;

a lug plate supported on the drive shaft for integral rotation therewith and loosely supporting said guide pins;

said guide pins and said lug plate tiltably supporting the swash plate;

said swash plate having an operation area receiving greatest load based on the reaction of compressed gas acting on the piston when the swash plate rotates, said operation area being located in a position on the swash plate corresponding to the guide pins and the lug plate along an axial direction with respect to the drive shaft;

said cylinder bore having an inner peripheral surface;

said piston having an outer peripheral surface;

said inner peripheral surface and said outer peripheral surface defining a clearance therebetween;

said swash plate having a bore for attaching the swash plate to a jig when the swash plate is ground; and said bore being arranged to allow the refrigerant gas flow out from the cylinder bore through the clearance to flow to and lubricate the operation area.

20. The lubricating structure as set forth in claim 19, wherein said bore is formed in a position radially offset with respect to the operation area.

21. The lubricating structure as set forth in claim 20, wherein said bore extends through the swash plate.

22. The lubricating structure as set forth in claim 21 further comprising means for discontinuing introduction of refrigerant gas from the external circuit to the compressor when the compressor is out of the operation, wherein said minimum inclining angle of the swash plate is slightly greater than zero degree so as to circulate the refrigerant gas within the compressor and lubricate the interior of the compressor.

* * * * *

UNITED STATES PATENT AND TRADEMARK OFFICE

CERTIFICATE OF CORRECTION

PATENT NO. : 5,915,928

DATED : June 29, 1999

INVENTOR(S) : Masakazu Murase, et. al.

It is certified that error appears in the above-identified patent and that said Letters Patent is hereby corrected as shown below:

Column 5, line 67, after "pistons" delete "to the".

Column 10, line 63, delete "tiltably"; line 64, after "plate" insert --tiltably--.

Column 11, line 66, change "loosingly" to --loosely--.

Signed and Sealed this

Twenty-sixth Day of December, 2000

*Attest:*

*Attesting Officer*

Q. TODD DICKINSON

*Director of Patents and Trademarks*